US005484268A

United States Patent [19]

Swank

[11] Patent Number: 5,484,268

[45] Date of Patent: Jan. 16, 1996

[54] POSITIVE DISPLACEMENT CENTRIFUGAL PUMP

[75] Inventor: Robert P. Swank, Mansfield, Ohio

[73] Assignee: Impact MST Incorporated, Cincinnati, Ohio

[21] Appl. No.: 92,356

[22] Filed: Jul. 15, 1993

Related U.S. Application Data

[63] Continuation-in-part of Ser. No. 637,602, Jan. 2, 1991, Pat. No. 5,228,840, which is a continuation-in-part of Ser. No. 271,166, Nov. 14, 1988, Pat. No. 4,990,062.

[51] Int. Cl.[6] ..... F04B 19/00

[52] U.S. Cl. ..... 417/211; 417/462; 417/328

[58] Field of Search ..... 417/211, 462, 417/328, 410.3, 572, 410.3, 269, 273; 92/68, 69 R, 137

[56] References Cited

U.S. PATENT DOCUMENTS

| | | | |
|---|---|---|---|
| 272,616 | 2/1883 | Annibale | 417/328 |
| 1,000,305 | 8/1911 | Smith | 417/462 |
| 1,370,305 | 3/1921 | Golle | 417/462 |
| 1,375,160 | 4/1921 | Kuehn | 417/462 |
| 1,511,985 | 10/1924 | Spencer | 225/51 |
| 1,857,720 | 5/1932 | Gerling | 417/378 |
| 2,019,023 | 10/1935 | Seilliere | 417/462 |
| 2,083,847 | 6/1937 | Johnson | 417/462 |
| 3,945,763 | 3/1976 | Terhune | 417/211 |
| 3,949,705 | 4/1976 | Portalis | 417/328 |
| 4,169,433 | 10/1979 | Crocker | 417/328 |
| 4,242,053 | 12/1980 | Mulvenna | 417/211 |

FOREIGN PATENT DOCUMENTS

| | | | |
|---|---|---|---|
| 1270413 | 11/1986 | U.S.S.R. | 417/211 |

*Primary Examiner*—Richard A. Bertsch
*Assistant Examiner*—Peter G. Korytnyk
*Attorney, Agent, or Firm*—Wood, Herron & Evans

[57] ABSTRACT

A positive displacement centrifugal pump comprises (a) a pressure generating mass rotatable about a first axis and radially movable relative to it upon rotation of the mass, (b) a pumping unit, and (c) a flexible, non-elastic tensioning element operatively connected to the mass and operable in the course of rotation of the mass to cause the mass to move radially inwardly toward the axis so as to effect intake and/or exhaust of fluid within the pump.

32 Claims, 5 Drawing Sheets

POSITIVE DISPLACEMENT CENTRIFUGAL PUMP

This application is a Continuation-In-Part application of U.S. application Ser. No. 07/637,602, filed Jan. 2, 1991, now U.S. Pat. No. 5,228,840 which is, in turn, a Continuation-In-Part application of U.S. application Ser. No. 07/271,166, filed Nov. 14, 1988, now U.S. Pat. No. 4,990,062.

FIELD OF THE INVENTION

This invention relates to positive displacement pumps and, more particularly, to positive displacement pumps of the type which utilize centrifugal force acting on a liquid or solid mass to effect and create pump pressure.

Positive displacement pumps are characterized by alternately filling and emptying an enclosed volume by the operation of a mechanism such as a reciprocating piston, meshing gears, sliding veins, screws, etc. The pumping mechanism, for example, a reciprocating piston, is movable within an enclosed chamber between an intake position in which negative pressure is created within the chamber to draw fluid therein, and an exhaust position in which the fluid drawn into the chamber is pressurized and/or exhausted through an outlet in the chamber. In many instances, the pumping mechanism is driven by an electric motor through a crank, or, alternately, the driving force for the pumping mechanism can be direct acting such as by steam or compressed air.

Positive displacement pumps of the type described above have a number of limitations, particularly, for certain types of applications. One problem is that the operation of the pumping mechanism is relatively loud. Reciprocating pistons or plungers, even if well lubricated, are relatively noisy when sliding within an enclosed chamber. Similarly, the pumping mechanism associated with rotary-type displacement pumps, e.g., meshing gears, sliding veins or screws, are also relatively noisy due to the metal-to-metal engagement of their moving parts.

A second problem with positive displacement pumps such as described above is that the pumping mechanisms and associated bearings must be lubricated to reduce wear and ensure smooth operation of the pump. As a result, the fluid being pumped comes into contact with the lubricated surfaces of the pumping mechanism and can pick up contaminants. This is unacceptable where the air or other fluid being pumped must be clean, such as in the pumping of air into an oxygen concentrator and similar applications in hospitals or other health care facilities. It is also important for pumps utilized in hospitals to operate quietly, and vibration-free, which is another deficiency of prior art positive displacement pumps.

A third problem with prior art positive displacement pumps is their limited capability to dissipate heat generated by the moving parts. Particularly at high operating speeds, the compression of the air being pumped, and the metal-to-metal contact between the pumping mechanisms, e.g., reciprocating pistons, meshing gears, etc., generates heat which is relatively slowly dissipated from such working parts through the walls of the enclosed chamber. After a period of operation, the temperature of the interior of the chamber may increase substantially leading to damage of the pump.

Another problem with prior art positive displacement pumps involves restarting the pump after it has been operated for a period of time and then shut down. Under these circumstances, the lines between the pump and fluid supply remain pressurized and make it difficult to initially move the pumping mechanism, e.g., a reciprocating piston, to overcome such "dead heads" or back pressure. Typically, in the prior art, this "dead head" or back pressure problem is resolved by incorporating a bleeder valve or other pressure relief device between the pump and fluid supply to eliminate back pressure. But, such devices add to the cost and complexity of the pumping system.

Another type of positive displacement pump has been proposed in the prior art which is shown, for example, in U.S. Pat. Nos. 901,344 to Horstmann; No. 1,511,985 to Spencer; No. 3,465,684 to Moll; and, No. 4,169,433 to Crocker. These pumps employ a "floating" piston which is freely movable within a cylinder having an inlet and an outlet. Movement of the piston within the cylinder in one direction creates a negative pressure therein which draws air through the inlet into the cylinder. Movement of the piston in the opposite direction forces the fluid through the outlet of the cylinder to create a pumping action.

According to the disclosure of these patents, movement of the floating piston within this cylinder is caused by rotating the cylinder and piston about a first axis so that centrifugal force is applied to the piston, and at the same time, rotating the cylinder about an axis passing through its midpoint so that the ends of the cylinder change position relative to the first axis. With the ends of the cylinder in one position, the piston is thrown radially outwardly toward one end of the cylinder by centrifugal force, and this movement either intakes or exhausts fluid from the cylinder. The cylinder is then rotated about its midpoint so that its ends switch position which, in turn, causes the piston to be moved by centrifugal force to the opposite end of the cylinder.

Positive displacement centrifugal pumps of the type described in these four patents are subject to criticism and have never been a commercial success because a high amount of energy is required to rotate the cylinder about its midpoint in order to move the piston from one end of the cylinder to the other. This problem is accentuated as the rotational speed of the piston and cylinder is increased in order to increase the pumping rate of the pump. Furthermore, such pumps are relatively noisy because the floating piston is allowed to contact the ends of the cylinder.

In my above-identified U.S. Pat. No. 4,990,062 and pending U.S. patent application Ser. No. 07/637,602, now U.S. Pat. No. 5,228,890 of which this application is a Continuation-In-Part, there are disclosed several different embodiments of centrifugal force actuated, positive displacement pumps which overcome all of the objections described hereinabove. That is, these pumps are quiet, vibration-free, free of lubricant contaminants, dissipate heat readily and require minimal energy to operate, even at high speeds. Generally, the embodiments of the centrifugal positive displacement pumps described in these parent applications comprise a mass rotatable relative to a first axis and movable by centrifugal force acting on the mass to create zones of higher pressure and lower pressure at differing distances from the axis of rotation. A number of pumping units associated with the movable mass are rotatable relative to a second axis such that the pumping units pass through the zones of higher and lower pressure, and pressure-responsive intake and exhaust valves associated with the pumping unit are effected to either intake fluid into the pumping unit or exhaust fluid therefrom in the course of moving between the zones of higher and lower pressure or force. These pumps are predicated upon the concept of creating differential pressure zones by the rotation of a mass relative to a first axis, and then moving a pumping unit having a plurality of pressure-responsive intake and exhaust members through these pressure zones to intake and exhaust fluid. The movable mass which is subjected to centrifugal force to create the differing pressure zones may take the form of either a body of liquid or semi-liquid material which fills or partially fills a pressure chamber or, alternatively, a solid mass. In all of these embodiments, though, the positive displacement centrifugal pump is relatively complex and expensive to manufacture.

SUMMARY OF THE INVENTION

It has therefore been an objective of this invention to provide a new and improved positive displacement centrifugal force pump which overcomes all of the disadvantages of prior art positive displacement pumps described hereinabove, but which is less complex and less expensive to manufacture than any of my earlier positive displacement centrifugal force pumps.

The positive displacement centrifugal force pump of this invention which accomplishes these objectives comprises a pressure generating mass which is rotatable about a first axis and which is subjected to centrifugal force in the course of rotation about that first axis. That centrifugal force causes the mass to move radially outwardly away from the axis. Associated with that pressure generating mass is a pumping unit, which may be in the form of a cylinder within which the pressure generating mass is movable. According to the practice of this invention, the pressure generating mass is attached to a non-elastic, flexible tensioning element such that in the course of each revolution or rotation of the mass, centrifugal force causes the mass to move radially outwardly and the non-elastic, flexible element causes the mass to be pulled radially inwardly. In several embodiments of this invention, the pressure generating mass is in the form of a piston, and the pumping unit includes a cylinder within which the piston is reciprocable. In one embodiment, the piston and cylinder are mounted for rotation about different axes such that during each revolution of the mass, the relative differing axes about which the piston and cylinder rotate, causes the piston to reciprocate within the cylinder and thereby effect intaking and exhausting of fluid from the cylinder. In another preferred embodiment of the invention, the pressure generating mass or piston is mounted for rotation about the same axis as the pumping unit, including the cylinder, but the non-elastic, flexible element is caused by a non-rotating cam or roller to lengthen and shorten relative to the axis of rotation of the piston and cylinder, thereby to effect reciprocation of the piston within the cylinder and resulting intake and exhausting of fluid from the cylinder. In yet another embodiment of this invention, the pressure generating mass and the pumping unit are rotatable about the same axis, but the pressure generating mass, rather than being a piston movable within a cylinder, comprises a weighted arm which moves radially outwardly as a result of centrifugal force applied to the arm when it is rotated and which is pulled inwardly by a cam operating upon a non-elastic, flexible tensioning element in the course of that same rotation. In this third embodiment, the weighted arm has attached to it a pumping unit which is separate from the pressure generating mass as opposed to being a part of that pumping unit.

DESCRIPTION OF THE DRAWINGS

The structure, operation and advantages of the presently preferred embodiments of this invention will become further apparent upon consideration of the following description taken in conjunction with the accompanying drawings, wherein.

BRIEF DESCRIPTION OF THE PREFERRED EMBODIMENTS

Figure 2:
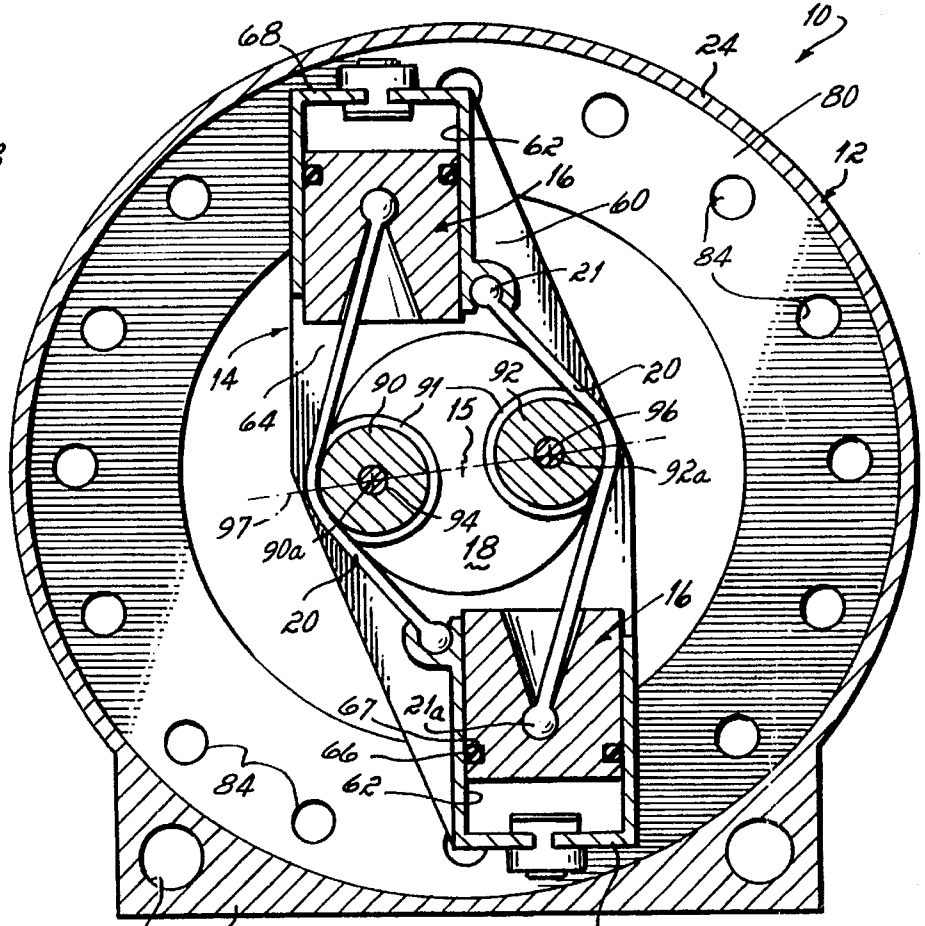
FIG. 2 is a cross sectional view taken on line 2—2 of FIG. 1.
Figure 1:
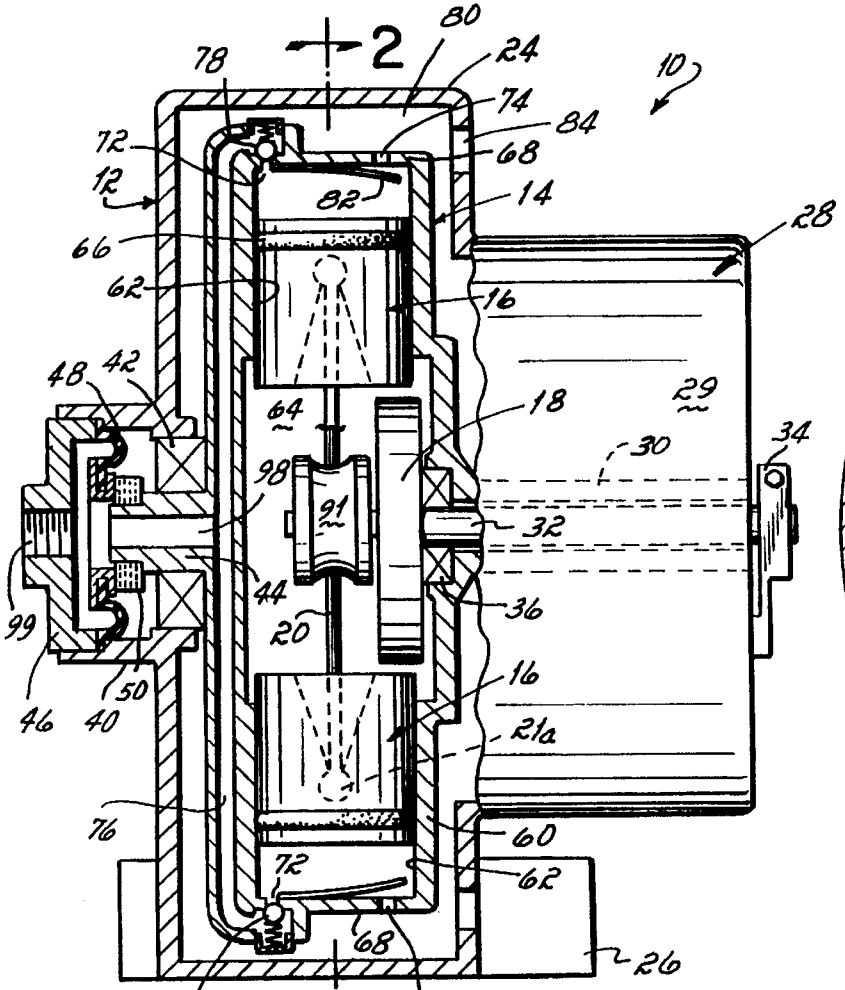
FIG. 1 is a side elevational view partially broken away of a second embodiment of this invention.
Figure 3:
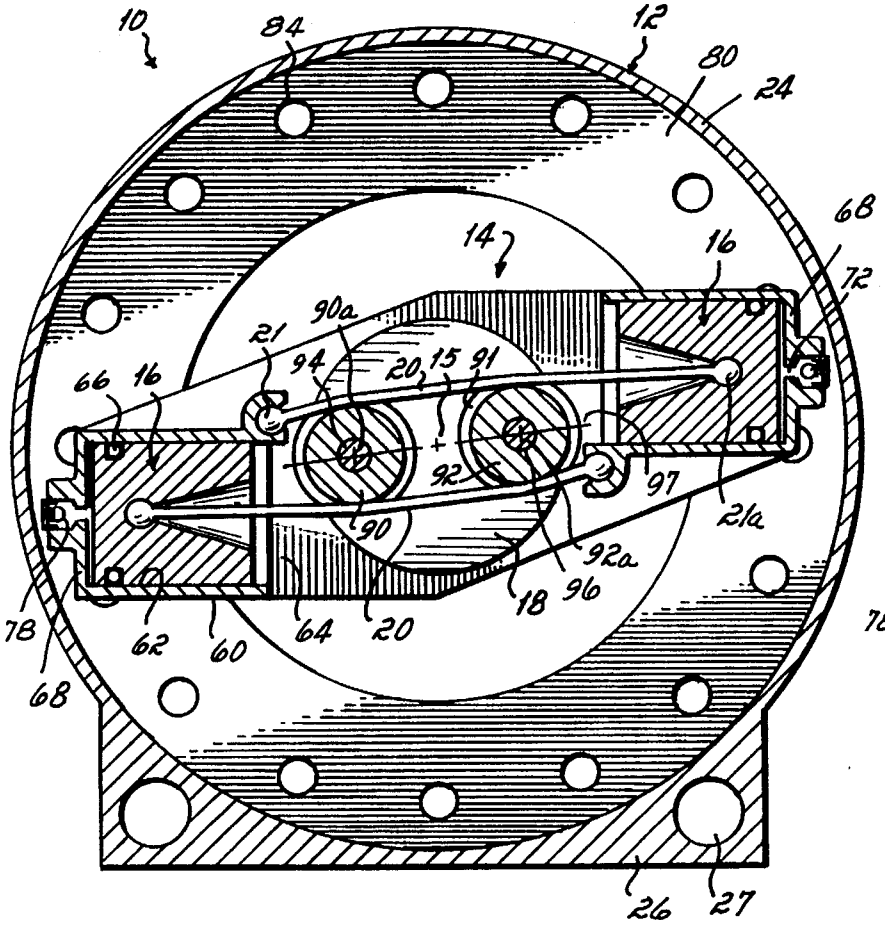
FIG. 3 is a view similar to FIG. 2, but illustrating the pressure generating mass and pumping unit in a second and differing relative position.

With reference first to FIGS. 1–3, there is illustrated one preferred embodiment of a fixed displacement centrifugal force pump 10 incorporating the invention of this application. This pump comprises a fixed housing 12 within which there is contained a rotatable pumping unit 14, the pumping action of which is effected by pressure generating masses in the form of pistons 16 contained within the pumping unit 14. Also mounted internally of the housing 12 is a stationary cam 18 operative through or by means of flexible, non-elastic tensioning connectors or ropes 20 to effect movement of the pistons 16 upon rotation of the pumping unit 14 relative to the stationary cam 18, as explained more fully hereinafter.

The housing 12 comprises a generally cylindrical tube or can 24 having a base 26 extending from one side. This base has apertures or holes 27 formed therein by means of which the housing may be secured or fixed to a stationary supporting surface. Attached to one side of the housing can or tube 24 is an electric motor 28, the exterior housing of which is fixedly attached to the housing 12 of the pump. This motor 28 has an output shaft 30 in the form of a hollow tube or sleeve which is connected to and operative to drive the pumping unit 14. Contained internally of the output drive sleeve 30 of the motor 28 is a non-rotatable or fixed shaft 32 to which the stationary cam 18 is attached. This shaft 32 is secured against rotation or movement by a bracket 34 fixedly attached to the housing or casing 29 of the electric motor 28. At its inner end, the shaft 32 is supported by a bearing 36 operative to support the pumping unit 14 for rotation relative to the non-rotatable shaft 32 and stationary cam 18.

On the side of the housing 12 opposite from the motor 28, a housing hub 40 extends outwardly from the housing. A bearing 42 is mounted internally of this housing hub and rotatably supports a hub portion 44 of the pumping unit 14. The pumping unit 14 is further supported for rotation by a second bearing (not shown) in the housing 12. Additionally, the end of the housing hub 40 is closed by a cap 46 press fit into the open end of the hub 40 and operative to secure a flexible seal 48 and packing 50 between the housing hub 40 of the pumping unit hub 44.

The pumping unit 14 comprises a pump body 60 fixedly secured to the motor output shaft 30 so as to be rotatable therewith. This pump body 60 has a pair of cylindrical bores 62 which open into a central cavity 64 in the center of the pump body 60. The pistons 16 which function as pressure generating masses are slidably mounted within the cylindrical bores 62 and are sealed relative thereto by piston seals 66 mounted in peripheral grooves 67 of the pistons.

The outer ends of the cylindrical bores 62 are closed by end walls 68 of the bores 62. These end walls 68 each contain two passages 72, 74, one of which communicates with an outlet passage 76 of the pumping unit via a one-way check valve 78 and the other 74 of which functions as an inlet passage for supplying air at atmospheric pressure from the interior 80 of the housing 12 to the interior of the cylinder 62 via a conventional reed or flapper valve 82. The interior of the pump housing 80 is open to atmosphere through ports 84 of the housing so that air pulled through the passage 74 via the open flapper valve 82 enters the pumping unit on the intake stroke of the piston at atmospheric pressure. Air then exits the cylinder 62 via the one-way check valve 78 as the piston 16 moves outwardly in the cylinder. During the course of this outward movement of the piston, the flapper valve 82 closes as a result of centrifugal force and its normal bias to a closed position.

In order to cause inward movement of the pistons 16 within the cylinder 62 upon rotation of the pumping unit 14, there are a pair of rollers 90, 92 mounted upon the stationary cam 18. These rollers are mounted eccentrically relative to the axis of rotation 15 of the pumping unit 14 and motor shaft 30. Each of these rollers 90, 92 is rotatably mounted upon a stub shaft 94, 96 of the stationary cam 18 and each has formed on its peripheral surface a peripheral groove 91 through which the connectors or ropes 20 move. Each of these ropes 20 has an enlarged bulbous end 21 at one end of the rope attached to the pump body 60 and another bulbous end **21*a* attached at the opposite end to one of the pistons 16. Between its ends 21, 21*a*, the rope 20 passes over one or both of the rollers 90, 92**, depending upon the position of those rollers relative to the pumping unit.

In operation of the pump 10, the pumping unit 14 is caused to rotate by the motor 28. In the course of rotation of the pumping unit, the pistons 16 contained within the cylinders 62 of the pumping unit are naturally thrown radially outwardly as a result of centrifugal force acting upon those pistons 16. The centrifugal force causing outward movement of those pistons is a function of the speed of the motor and the mass of the pistons. Preferably, the mass of the pistons is maximized by the pistons being made from a relatively heavy, dense material or having a heavy, dense material, as, for example, lead, inserted therein to increase their weight and mass. But those pistons can only move outwardly within the cylinders to the extent that the non-elastic, flexible ropes 20 permit those pistons to move outwardly.

With reference now to FIGS. 2 and 3, it will be seen that when the pumping unit is aligned generally perpendicularly to a plane 97 containing both axes **90*a*, 92*a* of the rollers 90, 92, the tension of the ropes acting on the pistons cause the pistons to be moved inwardly. As the pumping unit rotates 90° from the position illustrated in FIG. 2 to the position illustrated in FIG. 3, the tension on the ropes 20 is relaxed as the pumping unit becomes aligned with the plane 96 containing the axes of the rollers. This relaxation of the tension on the ropes permits centrifugal force to cause the pistons 16 to move outwardly within the cylinders 62. As the speed of rotation of the pumping unit 14 increases, the force causing the pistons to be moved outwardly increases as does the tensioning force required on the ropes 20 to pull the pistons inwardly. The pump 10 is thus characterized by having centrifugal force cause the pistons to move outwardly in the cylinders and tensioning force on the flexible rope 20 attached to the pistons to cause the pistons to move inwardly. The pistons go through a full cycle of inward and outward movement in the course of the pumping unit moving through 180° of rotation of the pumping unit relative to the housing 12 within which the pumping unit is contained. Or otherwise expressed, for each full revolution of the pumping unit, each piston goes through two reciprocal cycles. In the course of the pistons moving inwardly within the cylinders 62, air is pulled through the inlet passage 74 from the interior 80 of the pump housing into the cylinders 62. And as the pistons 16 moves outwardly in the cylinders 62, air is forced from the cylinders 62 via the check valve 78 into the outlet passage 76 of the pumping unit. This outlet passage 76 communicates with an outlet passage 98 of the pump contained within the hub 44 of the pumping unit and an outlet port 99 in the cap 46 of the pump housing 12. This port 99 is connected via a conventional conduit to a pneumatic motor or whatever machine is to be operated by the air pressure created by the pump 10**.

Figure 4:
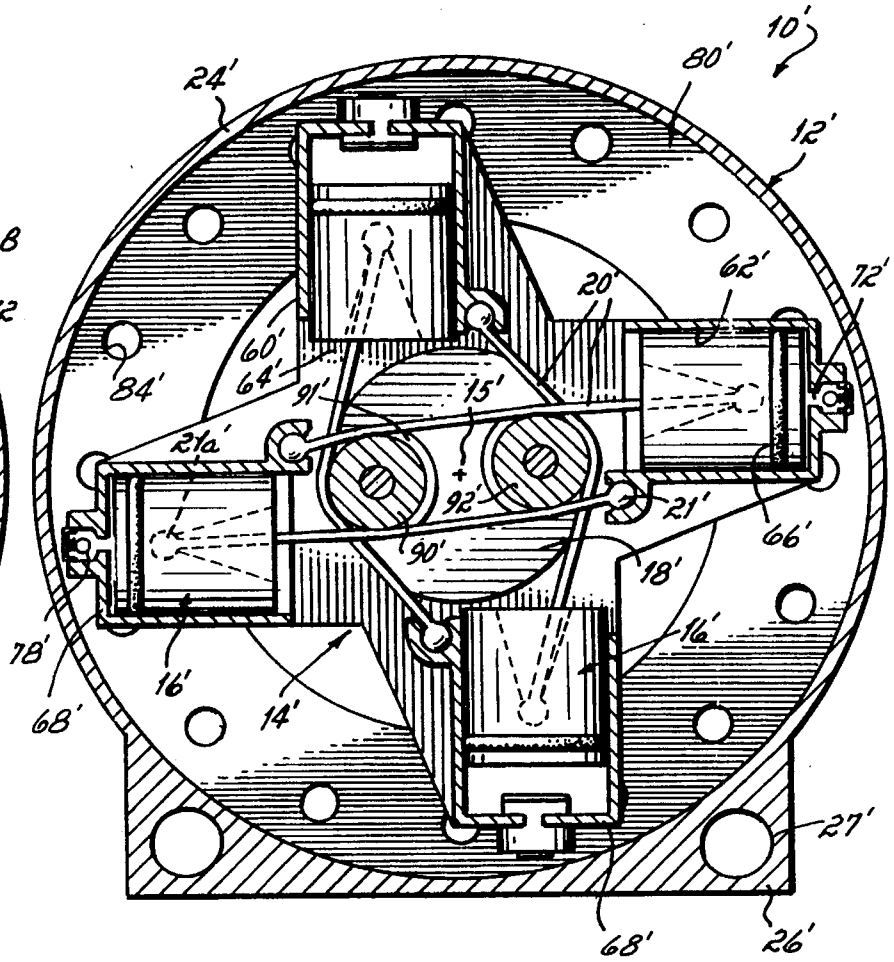
FIG. 4 is a cross sectional view of a second preferred embodiment of the invention.

With reference now to FIG. 4, there is illustrated a second embodiment of the fixed displacement centrifugal force pump of this invention. This embodiment is substantially identical to the embodiment of FIGS. 1–3 except that it incorporates four cylinders 62' and four pistons 16' mounted within the pump body 60' rather than just two as in the embodiment of FIGS. 1–3. In all other regards, except for there being two grooves 91' in each roller 90', 92' the embodiment of FIG. 4 is identical to the embodiment of FIGS. 1–3. Accordingly, those components of the embodiment of FIG. 4 which are identical or substantially identical to the embodiment of FIGS. 1–3 have been given identical numerical designations, but followed by a prime (') mark.

The embodiment of FIG. 4 operates in exactly the same way as the embodiment of FIG. 3. It has the advantage however of having the pumping unit balanced so that it may operate at a greater speed with less attention to balance and vibration. It also has the advantage, of course, of generating twice as much volume as the pump illustrated in the embodiment of FIGS. 1–3 with very little additional power input.

Figure 5:
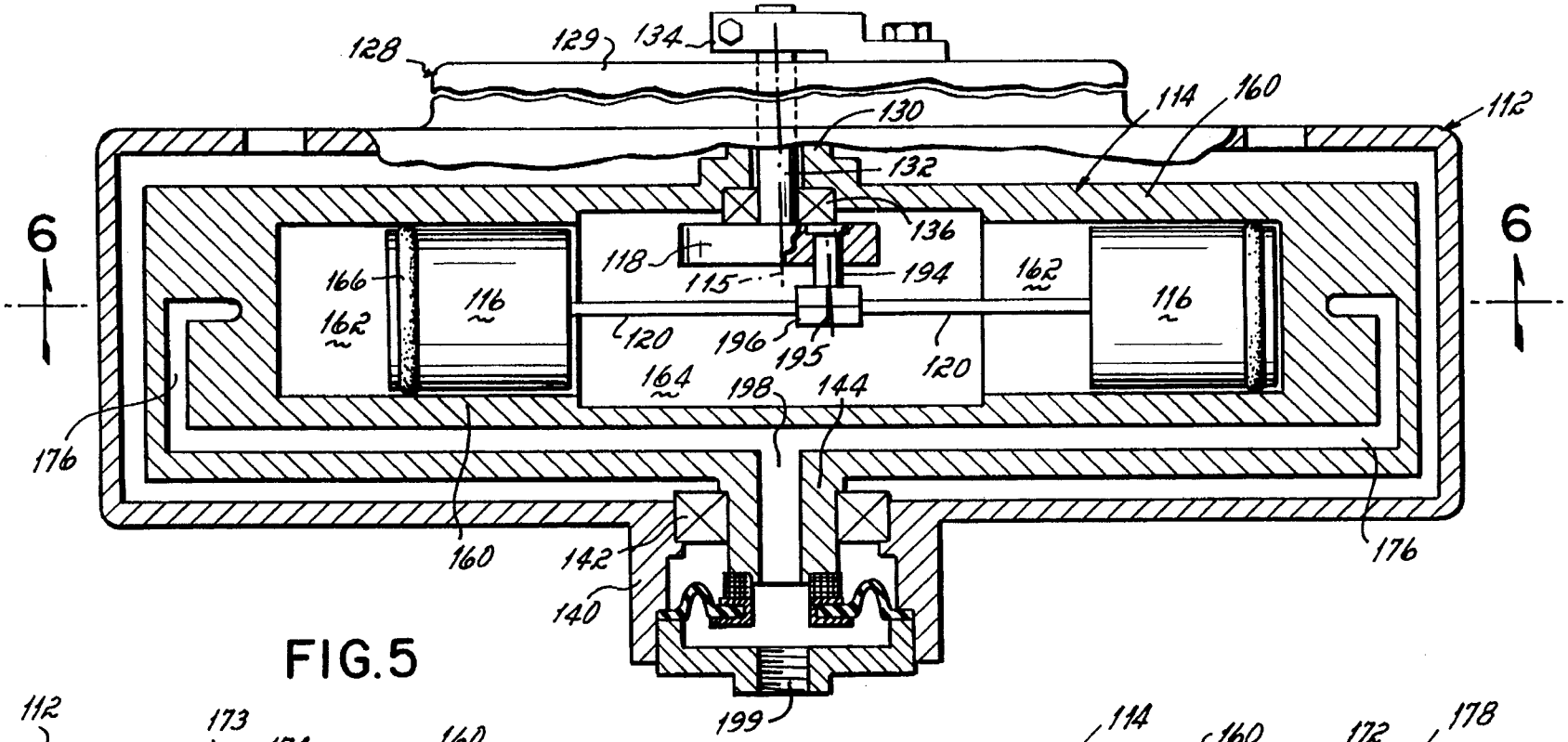
FIG. 5 is a top plan view, partially broken away, of a third embodiment of this invention.
Figure 6:
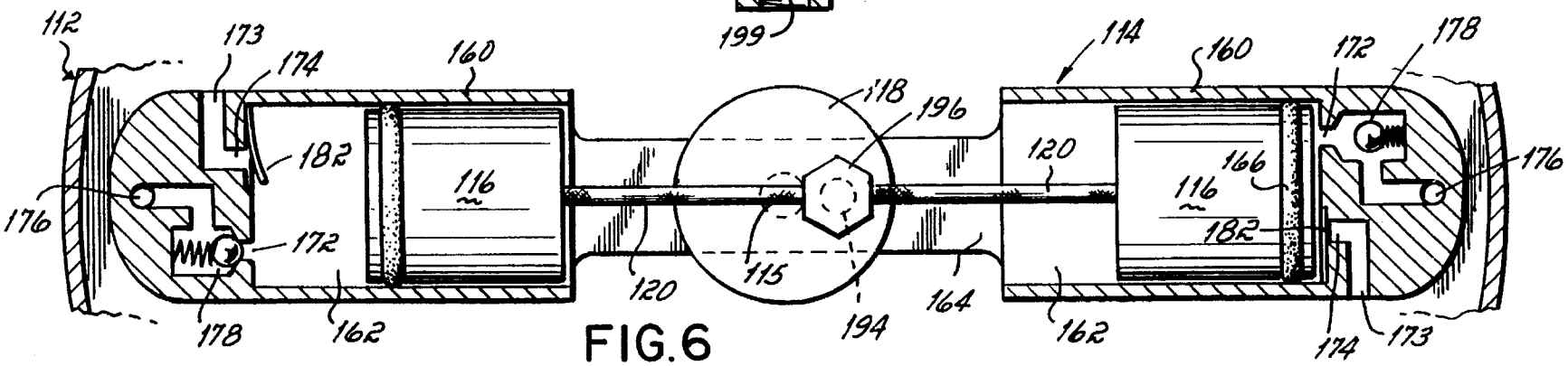
FIG. 6 is a cross sectional view taken on line 6—6 of FIG. 5.

With reference now to FIGS. 5 and 6, there is illustrated yet another embodiment of the invention of this application. This embodiment incorporates the same pump motor 128 and pump housing 112 to drive and rotate a pumping unit 114 contained within the housing 112 as in the embodiment of FIGS. 1–3. As in the embodiment of FIGS. 1–3, centrifugal force acting upon pressure generating masses in the form of pistons 116 contained internally of the pumping unit 114 are operative to effect outward movement of the pistons within cylinders 162 of the pumping unit and flexible, non-elastic ropes or tensioning members 120 effect inward movement of those pistons 116. In this embodiment, though, rather than rotating the pressure generating masses, i.e., the pistons, and the pumping unit 114 about the same axis as in the embodiment of FIGS. 1–3, the pressure generating masses or pistons 116 are rotated about a different axis than the axis about which the pumping unit 14 is rotated so that relative movement is effected between the pressure generating masses or pistons 116 and the cylinders 162 of the pumping unit 14 during each revolution of the pumping unit.

With reference to FIGS. 5 and 6, it will be seen that the pumping unit 114 comprises a pump body 160 mounted for rotation about an axis 115 and rotatably driven from and by a tubular output shaft 130 of the motor 128. The pump body has formed therein a pair of opposed cylinders 162 which are open at the inner end thereof to the open interior 164 of the pump body 160. The cylindrical pistons 116 are slidably mounted within these cylinders 162 and are sealed relative thereto by piston seals 166 mounted in peripheral annular grooves of the pistons. The pumping unit 114 is supported for rotation relative to the pump housing 112 on one side by a bearing 136 which is, in turn, supported upon a fixed shaft 132 extending through the hollow drive shaft 130 of the motor 128. This shaft is fixed against rotation by a bracket 134 fixedly secured to the motor housing 129. On the opposite side, the pumping unit is supported for rotation upon a bearing 142 mounted within a hub 140 of the pump housing 112. As a result of this mounting, the pumping unit is freely rotatable within the pump housing 112 and is rotatably driven therein by the electric motor 128 via the output shaft 130 of the motor.

The outer closed ends of the cylinders 162 each have an intake port 174 and an exhaust port 172 therein. The intake port 174 is closed by a normally closed flapper valve 182 which, when opened on the intake stroke of the pistons 116, connects the interior of the cylinders 162 to the interior of the pump housing 112 via an air flow passage 173.

The exhaust port 172 of the cylinder 162 is connected via a one-way check valve 178 to an air flow passage 176 which is, in turn, connected to the exhaust port 199 of the pump via an air flow passage 198 through the hub 144 of the pumping unit 114.

Mounted on the inner end of the shaft 132 is a stationary cam 118. This stationary cam has eccentrically mounted therein a rotatable shaft 194 at the outer end of which there is attached a hexagonal head 196. Fixedly attached to this hexagonal head are the inner ends of a pair of flexible, non-elastic tension members or ropes 120, the outer ends of which are fixedly attached to the pistons 116.

As in the earlier described embodiments of this invention, the pistons 116 act as pressure generating masses and are consequently made of a relatively heavy or dense material or have a heavier dense material inserted therein such that upon rotation of the pumping unit 114, the pistons 116 are caused to be thrown outwardly to the limits permitted by the tensioning members or ropes 120.

In the operation of the fixed displacement centrifugal pump of FIGS. 5 and 6, the pumping unit 114 rotates about the axis 115 of the drive shaft 130, but the pressure generating masses or pistons 116 rotate about the axis 195 of the eccentrically mounted shaft 194. Since the shaft 194 is mounted in the stationary cam 118, the axis 195 of the shaft 194 remains fixed during rotation of the pumping unit and the cylinders 162 about the axis 115. Thus with each revolution of the pumping unit 114, each piston is caused to move inwardly a distance equal to the distance between the two axes 115, 195 and then outwardly this same distance. The force with which it moves outwardly and thus the pressure generated in the chambers of the cylinders 162 is a function of the speed of rotation of the pumping unit and the mass of the pistons 116. Centrifugal force causes those pistons to be thrown outwardly as the pumping unit is rotated and the flexible, non-elastic tensioning members or ropes 120 cause those pistons to be pulled inwardly. As one piston 116 moves outwardly to force air from the chamber out through the discharge port of the pump, the other piston moves inwardly and draws air into the chamber 162 of its cylinder and then the action is reversed during the next 180° of rotation of the pumping unit. It will be noted, though, that in this embodiment, as in the earlier embodiments, centrifugal force causes outward movement of the pistons and tensioning on the rope 120 pulls the pistons inwardly against that centrifugal force.

With reference now to FIGS. 7–10, there is illustrated yet another embodiment of the invention of this application. In this embodiment, the pressure generating masses 216 of the pump 210 are physically separated from the pumping unit 214 although it is operative to effect and control operation of the pumping unit upon rotation of the pressure generating masses 216. In this embodiment, though, as in all of the earlier embodiments, the force tending to move the pressure generating masses 216 radially outwardly relative to their axis of rotation 223 is centrifugal force, and the force which pulls the masses inwardly against centrifugal force during rotation of the masses is a flexible tensioning member or rope, in this case, an endless such flexible tensioning member or rope 220.

The pump 210 of this embodiment is mounted within a fixed housing, indicated diagrammatically at 212. This housing has mounted in its upper end the non-rotatable pumping unit 214 beneath which there is located a pressure generating mechanism 215, which pressure generating mechanism 215 includes a pair of rotatable radially movable arms 216. These rotatable arms function as the pressure generating masses in this embodiment. When rotated, these arms are forced outwardly by centrifugal force to the position illustrated in FIG. 7. In this embodiment, the flexible tensioning member or cord is an endless flexible member 220 rather than a cord of finite length as in the earlier described embodiments.

Figure 8:
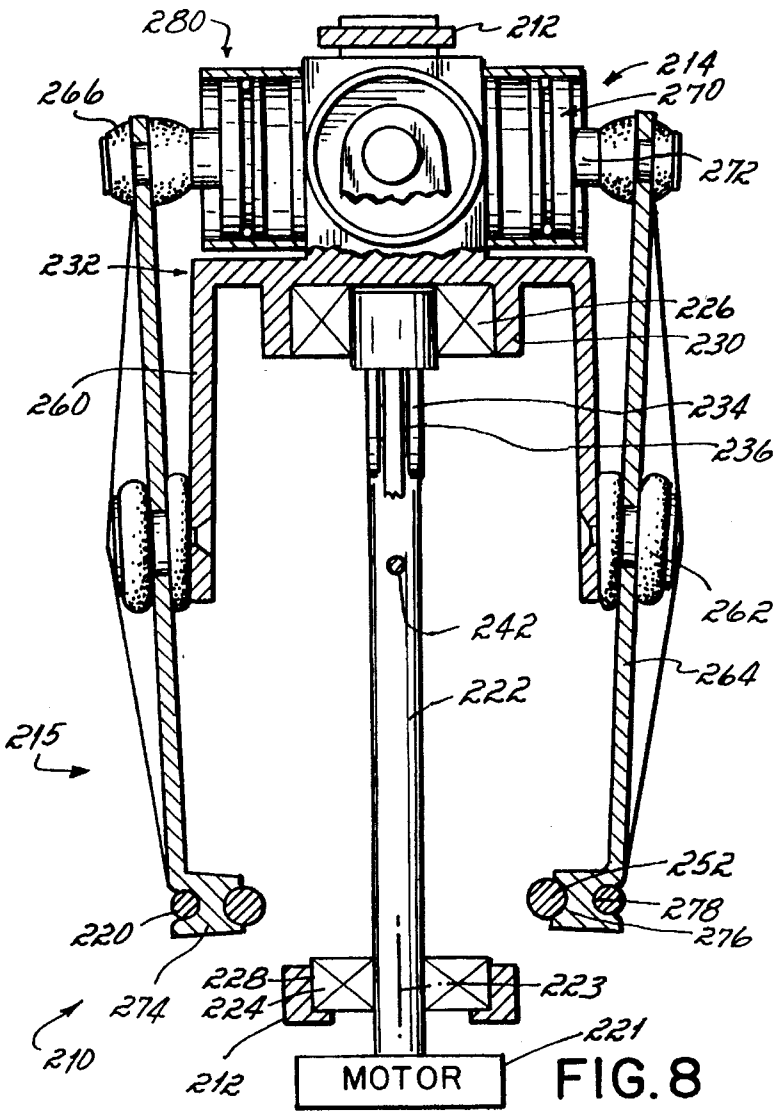
FIG. 8 is a cross sectional view taken on line 8—8 of FIG. 7.
Figure 7:
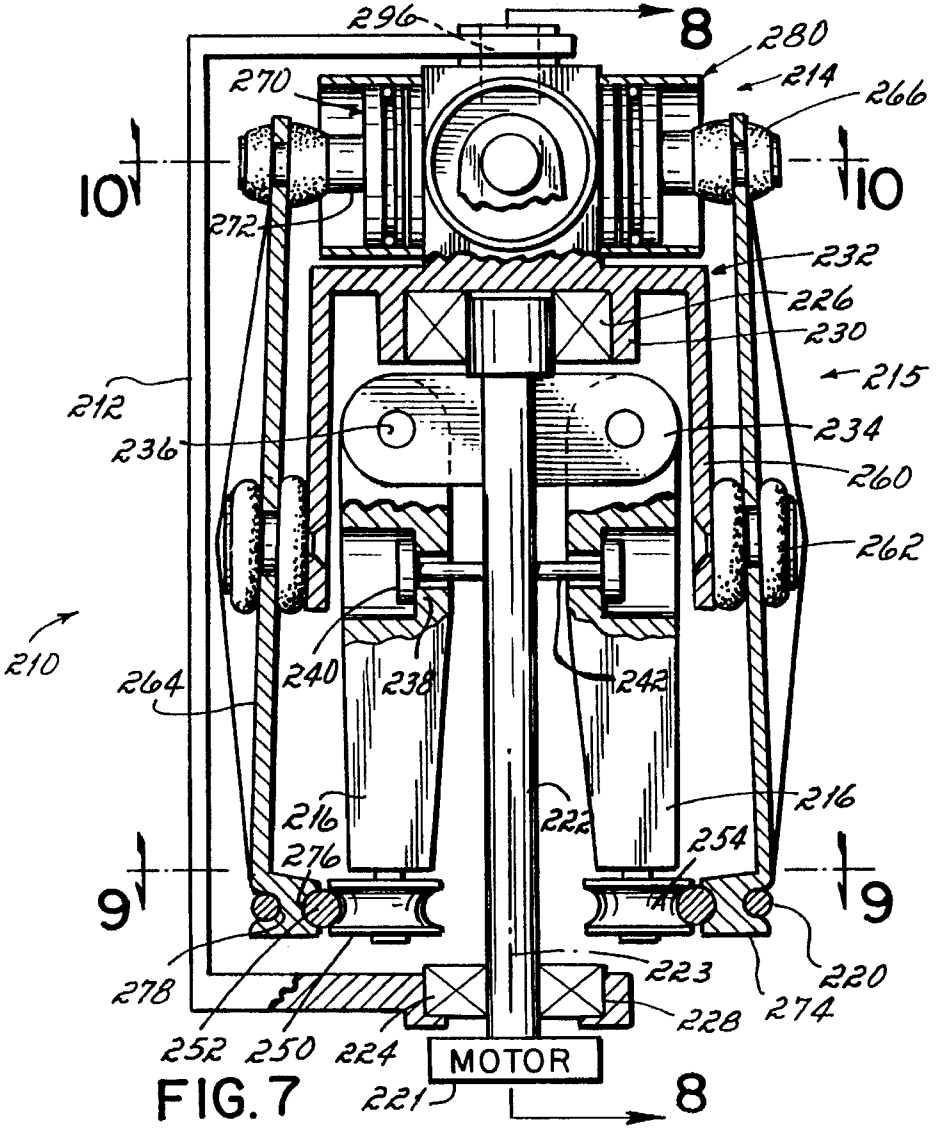
FIG. 7 is a side elevational view, partially broken away, of a fourth embodiment of the invention.

The pressure generating mechanism 215 comprises an electric motor 221 having a driven shaft 222 mounted internally of the housing 212 and supported for rotation therein by bearings 224 and 226. The bearing 224 is mounted in a counterbored aperture 228 in the bottom of the housing while the bearing 226 is mounted within an annular depending flange 230 of the body 232 of the pumping unit 214. Extending radially outwardly from the upper end of the shaft 222, there are two bifurcated arms 234, each one of which has one of the radially movable arms 216 pivotally suspended therefrom upon a pivot shaft 236. The connection of the arms 216 to the shaft 222 is such that upon rotation of the shaft, the lower unsupported ends of the arms 216 are free to swing radially outwardly away from the shaft 222 as a result of centrifugal force operating upon the masses of those arms 216. The arms are free to move outwardly until stop surfaces 238 of the arms engage the head 240 of pins 242. These pins extend radially outwardly from and are fixedly attached to the shaft 222. The pins, though, permit the lower ends of the arms to freely move radially inwardly as illustrated in FIG. 8.

Mounted on the lower end of each of the arms 216 there is a peripherally grooved roller 250. A low friction oblong endless guide belt or track 252 surrounds the two rollers and is supported within the peripheral grooves 254 of the rollers 250. This oblong guide track 252 does not rotate, but rather remains stationary as the rollers move over the track. Preferably, the endless guide track 252 is made from a urethane plastic.

Extending downwardly from the bottom of the body 232 of the pumping unit 214 are four depending legs 260. Each one of these legs has mounted on its lower end a pillow block 262 which supports a rocker arm 264 for oscillatory movement relative to the pillow block. At its upper end, each rocker arm is connected by another pillow block 266 to one of the pistons 270 of the pumping unit 214 via a piston rod 272. At its lower end, each rocker arm 264 has a guide block 274 formed thereon, which guide block has an inner groove 276 engaged with the outer surface of the endless guide belt 252 and an outer groove 278 within which the endless flexible tensioning member 220 resides.

Figure 10:
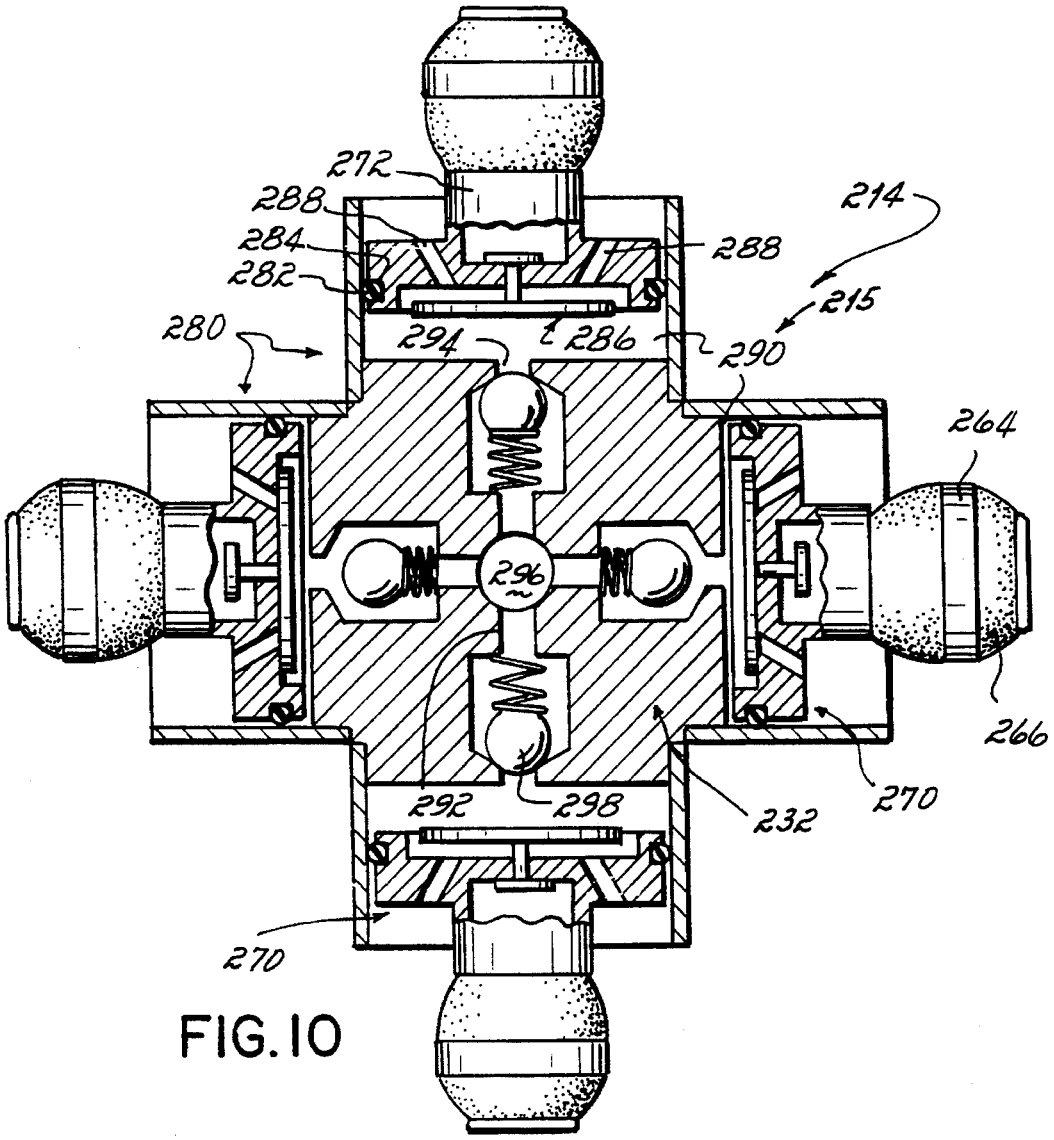
FIG. 10 is a cross sectional view taken on line 10—10 of FIG. 7.

With reference particularly to FIG. 10, it will be seen that the pumping unit 214 comprises the pump body 232 from which there extend four cylinders 280. Each of these cylinders has one of the pistons 270 slidably mounted therein and sealed relative thereto by a piston seal 282 located within a peripheral groove 284 of the piston. Slidably mounted within each piston there is a disc valve 286 operable to selectively open and close intake passages 288 of the piston. This valve 286 is operable as the piston moves outwardly to uncover and open the intake passages 288 so as to permit air at atmospheric pressure to enter the pressure chamber 290 of the cylinder. When the piston is moved inwardly and the chamber 290 is pressurized, this disc valve closes and covers the passages 288 so as to prevent the pressurized air from escaping therethrough.

Located within the pumping unit body 232, there are four radially extending passages 292, each one of which connects a discharge port 294 of one of the pressure chambers 290 to a central outlet port 296 of the pump. A check valve 298 is located within each of these passages 294 and is operable to open and permit the egress of pressurized air from the chamber 290 when the pistons are moved inwardly. Pressurized air from the chambers 290 flows through the passages 292 to the outlet passage 296 of the pump 210. These check valves are all spring-biased to a closed position and thus automatically close when the pistons move outwardly.

Figure 9:
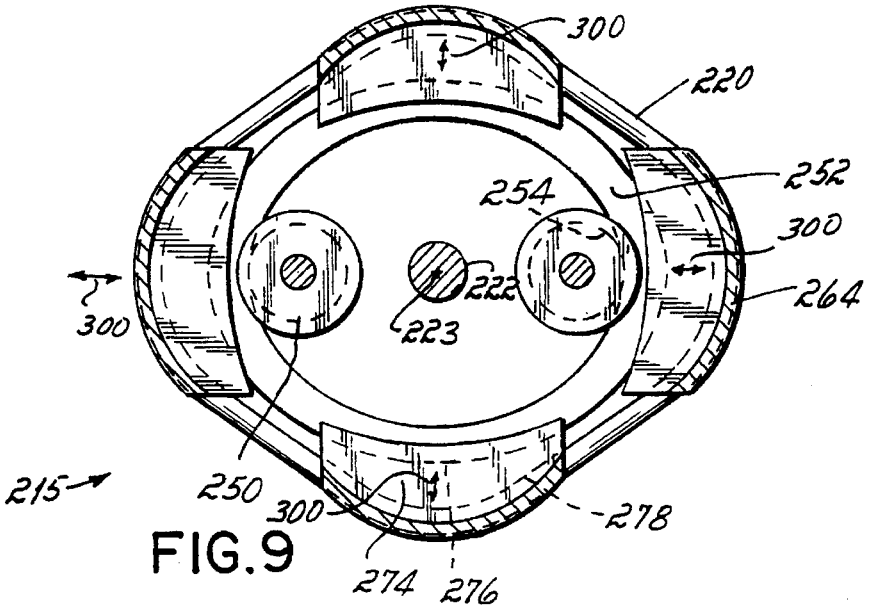
FIG. 9 is a cross sectional view taken on line 9—9 of FIG. 7.

In operation of the fixed displacement centrifugal force pump illustrated in FIGS. 7–10, the pump is caused to operate by the electric motor 221. Rotation of the output shaft 222 of the motor 221 results in centrifugal force forcing the lower ends of the pair of radially movable arms 216 with their relatively heavy masses radially outwardly to the extent that such movement is permitted by the stop pins 242. As the arms rotate, they cause the rocker arms 264 to alternately move outwardly as the rollers move into positions adjacent the guide blocks 274 of the rocker arms and then inwardly as the rollers move away from or 90° out of alignment with the rollers. As the rollers move away from the guide blocks, the flexible tensioning member 220 forces the guide blocks 274 to move inwardly toward the axis 223 of shaft 222. The lower ends of the rocker arms 264, which do not rotate with the pressure generating mechanism 215, are thereby caused to oscillate as indicated by the arrows 300 (FIG. 9). As the lower ends of the rocker arms oscillate, they in turn effect oscillation of the upper ends of the rocker arms 264, resulting in reciprocation of the pistons 270 attached to those oscillating rocker arms. As the pistons 270 reciprocate, air is drawn into the chambers 290 of the cylinders 284 during the intake stroke or outward movement of the pistons in the cylinders 280 and then is exhausted from those chambers 290 during the exhaust stroke as the pistons move inwardly forcing air from the chambers through the outlet passages 292 and 296 out of the pump.

It is to be noted that in this embodiment, the urethane endless guide belt 252 does not function as a tensioning member, but merely serves as a guide surface over which the rollers 250 move. This guide belt 252 thus functions to smooth out the operation of the pump. It does, however, permit centrifugal force to cause the lower ends of the rocker arms and the attached guide blocks to be moved outwardly away from and then inwardly toward the axis 223 of the shaft 222. Return or inward force is created solely by the endless flexible tensioning member or cord 220 as permitted by guide belt 252.

It will now be appreciated that in the embodiment illustrated in FIGS. 7–10, as in the earlier embodiments illustrated in FIGS. 1–6, outward radial movement of the rotating pressure generating masses is caused by centrifugal force and inward movement of those masses acting against centrifugal force is created by the flexible tensioning member 220. In the earlier embodiments of FIGS. 1–6, that flexible tensioning member was a finite length flexible cord, but in this last embodiment of FIGS. 7–10, that flexible tensioning member is an endless flexible member or cord 220.

The several different embodiments of the invention of this application described herein all are characterized by being relatively inexpensive, simple fluid pumps which are all capable of pumping clean air or fluid uncontaminated by any lubricant. It will also be appreciated that these pumps are all very quiet in operation and all are characterized by being capable of a soft start under load.

While I have described several different embodiments of my invention, persons skilled in this art will appreciate other changes and modifications which may be made without departing from the spirit of my invention. Therefore, I do not intend to be limited except by the scope of the following appended claims.

I claim:

1. A positive displacement centrifugal pump apparatus for pumping fluid, comprising:

a pressure generating mass, said mass being rotatable and radially movable relative to a first axis;

a pumping unit having intake and exhaust means for intaking and exhausting fluid;

tensioning means including a flexible, non-elastic tensioning element operatively connected to said mass;

rotating means for effecting rotation of said mass relative to said first axis such that centrifugal force acting on said mass in the course of rotation and without the application of any other force to said mass forces said mass to move radially outwardly away from said first axis and said tensioning means in the course of rotation of said mass is operable to cause said mass to move radially inwardly toward said axis; and means interconnecting said mass to said pumping unit whereby inward and outward radial movement of said mass relative to said axis effects intake and exhaust of fluid from said pumping unit.

2. The apparatus of claim 1 wherein said mass and said pumping unit are simultaneously rotatable.

3. The apparatus of claim. 1 wherein said tensioning element is of finite length.

4. The apparatus of claim 1 wherein said pressure generating mass comprises pistons movable within cylinders of said pumping unit.

5. The apparatus of claim 4 wherein said flexible, non-elastic tensioning element is connected at one end to said piston and is connected at the opposite end to a rotatable pin, said rotatable pin being rotatable about a second axis which is parallel to said first axis, but displaced relative thereto.

6. A positive displacement centrifugal pump apparatus for pumping fluid, comprising:

a pressure generating mass, said mass being rotatable and radially movable relative to a first axis such that centrifugal force applied to said mass in the course of rotation forces said mass to move radially outwardly away from said first axis;

a pumping unit having intake and exhaust means for intaking and exhausting fluid;

means including a flexible, non-elastic tensioning element operatively connected to said mass and operable in the course of rotation of said mass to cause said mass to move radially inwardly toward said axis;

means interconnecting said mass to said pumping unit whereby inward and outward radial movement of said mass relative to said axis effects intake and exhaust of fluid from said pumping unit; and said pumping unit remaining stationary as said pressure generating mass is rotated to effect operation of said pumping unit.

7. A positive displacement centrifugal pump apparatus for pumping fluid, comprising:

a pressure generating mass, said mass being rotatable and radially movable relative to a first axis such that centrifugal force applied to said mass in the course of rotation forces said mass to move radially outwardly away from said first axis;

a pumping unit having intake and exhaust means for intaking and exhausting fluid;

means including a flexible, non-elastic tensioning element operatively connected to said mass and operable in the course of rotation of said mass to cause said mass to move radially inwardly toward said axis;

means interconnecting said mass to said pumping unit whereby inward and outward radial movement of said mass relative to said axis effects intake and exhaust of fluid from said pumping unit; and said mass and said pumping unit both being rotatable about a common axis.

8. The apparatus of claim 1 wherein said mass and said pumping unit both rotate about axes which are displaced relative to each other.

9. A positive displacement centrifugal pump apparatus for pumping fluid, comprising:

a pressure generating mass, said mass being rotatable and radially movable relative to a first axis such that centrifugal force applied to said mass in the course of rotation forces said mass to move radially outwardly away from said first axis;

a pumping unit having intake and exhaust means for intaking and exhausting fluid;

means including a flexible, non-elastic tensioning element operatively connected to said mass and operable in the course of rotation of said mass to cause said mass to move radially inwardly toward said axis;

means interconnecting said mass to said pumping unit whereby inward and outward radial movement of said mass relative to said axis effects intake and exhaust of fluid from said pumping unit; and said tensioning element being endless.

10. A positive displacement centrifugal pump apparatus for pumping fluid, comprising:

a pressure generating mass, said mass being rotatable and radially movable relative to a first axis such that centrifugal force applied to said mass in the course of rotation forces said mass to move radially outwardly away from said first axis;

a pumping unit having intake and exhaust means for intaking and exhausting fluid;

means including a flexible, non-elastic tensioning element operatively connected to said mass and operable in the course of rotation of said mass to cause said mass to move radially inwardly toward said axis;

means interconnecting said mass to said pumping unit whereby inward and outward radial movement of said mass relative to said axis effects intake and exhaust of fluid from, said pumping unit;

said pressure generating mass comprising pistons movable within cylinders of said pumping unit; and said flexible, non-elastic tensioning element being attached at one end to a piston and being attached at the opposite end to a portion of said pumping unit and between said ends passing over a cam surface.

11. The apparatus of claim 10 wherein said cam comprises a rotatable cam surface eccentrically positioned relative to said first axis.

12. A positive displacement centrifugal pump apparatus for pumping fluid, comprising:

a pressure generating mass, said mass being rotatable and radially movable relative to a first axis such that centrifugal force applied to said mass in the course of rotation force said means to move radially outwardly away from said first axis;

a pumping unit having intake and exhaust means for intaking and exhausting fluid;

means including a flexible, non-elastic tensioning element operatively connected to said mass and operable in the course of rotation of said mass to cause said mass to move radially inwardly toward said axis;

means interconnecting said mass to said pumping unit whereby inward and outward radial movement of said mass relative to said axis effects intake and exhaust of fluid from said pumping unit; and said pressure generating mass comprising a plurality of arms pivotally mounted at one end for pivotal movement about pivot axes which are perpendicular to said first axis.

13. The apparatus of claim 12 wherein each of said pivot axes is located at one end of one of said arms, each arm having a roller mounted on the opposite end thereof.

14. The apparatus of claim 13 which further includes an endless guide belt engageable with each of said rollers and over which said rollers are movable during rotation of said arms.

15. A positive displacement centrifugal pump apparatus for pumping fluid, comprising:

a pressure generating mass said mass being rotatable and radially movable relative to a first axis such that centrifugal force applied to said mass in the course of rotation forces said mass to move radially outwardly away from said first axis;

pumping unit having intake and exhaust means for intaking and exhausting fluid;

means including a flexible, non-elastic tensioning element operatively connected to said mass and operable in the course of rotation of said mass to cause said mass to move radially inwardly toward said axis;

means interconnecting said mass to said pumping unit whereby inward and outward radial movement of said mass relative to said axis effects intake and exhaust of fluid from said pumping unit; and said means interconnecting said mass and said pumping unit comprising a plurality of rocker arms, each of said rocker arms having opposed ends and being supported intermediate of its ends for oscillatory movement.

16. The apparatus of claim 15 wherein each of said rocker arms has one end operatively connected to a positive displacement element of said pumping unit, and the other end operatively connected to said pressure generating mass.

17. The apparatus of claim 16 wherein said other end of each of said rocker arms is operatively connected to said flexible, non-elastic tensioning element.

18. The apparatus of claim 17 wherein said flexible, non-elastic tensioning element comprises an endless tensioning member.

19. The apparatus of claim 18 wherein said pressure generating mass comprises a plurality of pivotally mounted arms, each of said arms having one end radially movable relative to said first axis and a second end secured against radial movement relative to said first axis.

20. The apparatus of claim 19 wherein a roller is attached to said one end of each of said arms and further comprising endless guide means for guiding movement of said rollers during rotation of said pressure generating mass.

21. A positive displacement pump apparatus for pumping fluid, comprising:

a first means rotatable about a first axis, a second means radially movable outwardly away from said first axis solely in response to centrifugal force acting upon one of said first and second means upon rotation of said first means;

a pumping unit having intake and exhaust means for intaking and exhausting fluid;

means including a flexible, non-elastic tensioning element operatively connected to said second means and operable in the course of rotation of said first means to permit said second means to move radially outwardly and to cause said second means to move radially inwardly relative to said axis; and means interconnecting said second means to said pumping unit whereby inward and outward radial movement of said second means relative to said axis effects intake and exhaust of fluid from said pumping unit.

22. The apparatus of claim 21 wherein said second means comprises a plurality of oscillatable elements.

23. The apparatus of claim 22 wherein each of said first means comprises pivotally mounted arms, each arm of which is pivotable about a pivot axis located at one end of each of said arms, each arm having a roller mounted on the opposite end thereof.

24. The apparatus of claim 23 which further includes an endless guide belt engageable with each of said rollers and over which said rollers are movable during rotation of said arms.

25. The apparatus of claim 21 wherein said second means comprises a plurality of rocker arms, each of said rocker arms being supported intermediate of its ends for oscillatory movement.

26. The apparatus of claim 25 wherein each of said rocker arms has one end operatively connected to a positive displacement element of said pumping unit.

27. The apparatus of claim 26 wherein each of said rocker arms has a second end operatively connected to said flexible, non-elastic tensioning element.

28. The apparatus of claim 27 wherein said flexible, non-elastic tensioning element comprises an endless tensioning member.

29. The apparatus of claim 21 wherein said second means comprises a plurality of pivotally mounted arms, each of said arms having one portion radially movable relative to said first axis and a second portion secured against radial movement relative to said first axis.

30. The apparatus of claim 29 wherein said first means comprises a pair of rollers rotatable about said first axis and operatively associated with said first portion of each of said arms, said apparatus further comprising endless guide means for guiding movement of said rollers during rotation of rollers about said first axis.

31. A positive displacement pump apparatus for pumping fluid, comprising:

first means rotatable about a first axis, a second means radially movable relative to said first axis in response to rotation of said first means;

a pumping unit having intake and exhaust means for intaking and exhausting fluid;

means including a flexible, non-elastic tensioning element operatively connected to said second means and operable in the course of rotation of said first means to permit said second means to move radially outwardly and to cause said second means to move radially inwardly relative to said axis;

means interconnecting said second means to said pumping unit whereby inward and outward radial movement of said second means relating to said axis effects intake and exhaust of fluid from said pumping unit; and said first means comprising a pair of rollers.

32. A positive displacement pump apparatus for pumping fluid, comprising:

a first means rotatable about a first axis, a second means radially movable relative to said first axis in response to rotation of said first means;

a pumping unit having intake and exhaust means for intaking and exhausting fluid;

means including a flexible, non-elastic tensioning element operatively connected to said second means and operable in the course of rotation of said first means to permit said second means to move radially outwardly and to cause said second means to move radially inwardly relative to said axis;

means interconnecting said second means to said pumping unit whereby inward and outward radial movement of said second means relative to said axis effects intake and exhaust of fluid from said pumping unit; and said pumping unit remaining stationary as said first means is rotated to effect operation of said pumping unit.

* * * * *

UNITED STATES PATENT AND TRADEMARK OFFICE

CERTIFICATE OF CORRECTION

PATENT NO. : 5,484,268

DATED : January 16, 1996

INVENTOR(S) : Robert P. Swank

It is certified that error appears in the above-indentified patent and that said Letters Patent is hereby corrected as shown below:

Column 12, line 23, "force said means" should be ---forces said mass---.

Column 14, line 20, "first means" should be ---a first means---.

Column 14, line 33, "relating" should be --relative---.

Signed and Sealed this

Eleventh Day of June, 1996

*Attest:*

*Attesting Officer*

BRUCE LEHMAN

*Commissioner of Patents and Trademarks*